United States Patent [19]

Brown

[11] 4,192,431

[45] Mar. 11, 1980

[54] MICROWAVE OVEN SINGLE WALL CONSTRUCTION

[75] Inventor: Richard C. Brown, Dayton, Ohio

[73] Assignee: General Motors Corporation, Detroit, Mich.

[21] Appl. No.: 2,236

[22] Filed: Jan. 9, 1979

Related U.S. Application Data

[63] Continuation-in-part of Ser. No. 844,971, Oct. 25, 1971, abandoned.

[51] Int. Cl.[2] ..... B65D 7/42; H05B 9/06; B65D 5/48

[52] U.S. Cl. ..... 220/62; 219/10.55 E; 229/27

[58] Field of Search ..... 220/62, 83, 74; 229/27, 229/28 R; 219/10.55 R, 10.55 E; 228/169, 170, 171, 174, 167; 428/583, 584

[56] References Cited

U.S. PATENT DOCUMENTS

| | | | |
|---|---|---|---|
| 2,226,670 | 12/1940 | Pratt et al. | 220/62 |
| 2,375,242 | 5/1945 | Lockwood et al. | 220/62 |
| 2,423,863 | 7/1947 | Wales | 220/62 X |
| 2,459,921 | 1/1949 | Comer | 220/62 |
| 2,793,092 | 5/1957 | Peterson | 220/345 |
| 2,983,421 | 5/1961 | Turpin | 229/27 X |
| 3,116,004 | 12/1963 | Tyrseek et al. | 229/27 |
| 3,129,841 | 4/1964 | Loewenthal et al. | 220/62 |
| 3,231,247 | 1/1966 | Goettl | 220/62 |
| 3,934,106 | 1/1976 | MacMaster et al. | 219/10.55 E |
| 4,080,524 | 3/1978 | Greenfield et al. | 219/10.55 E |

*Primary Examiner*—Steven M. Pollard
*Attorney, Agent, or Firm*—Pearne, Gordon, Sessions

[57] ABSTRACT

Metallic sheet stock is stamped to define a one-piece blank with five transverse fold lines providing five panels foldable into side-by-side closed rectangular loop sections partially defining cooking and control compartments. A forward edge of the blank has three longitudinal fold lines forming a channel framing the openings for the cooking and control compartments. A pattern of notched-out areas at the intersection of the longitudinal and transverse fold lines define gussets which are folded to a common diagonal plane with respect to the corner junctures and upon being secured to each other at the plane define a rigid frame structure supporting a cabinet door adapted for closing the opening of the cooking compartment.

3 Claims, 16 Drawing Figures

MICROWAVE OVEN SINGLE WALL CONSTRUCTION

This is a Continuation-in-Part of U.S. patent application Ser. No. 844,971, filed Oct. 25, 1977, now abandoned.

This invention relates in general to an improved microwave oven cabinet construction and more particularly to a cabinet shell stamped out from a single metallic blank.

Microwave ovens have heretofore been manufactured with a separate inner cavity or chamber surrounded by or finished by a separate outer wrapper, often spaced away from one or more of the inner enclosure or oven chamber walls. Examples of such construction are shown in U.S. Pat. No. 3,867,605 to Yee, issued Feb. 18, 1975, and U.S. Pat. No. 3,783,219 to Tateda, issued Jan. 1, 1974.

It is an object of the present invention to provide an improved microwave oven construction which can be formed and assembled with as few parts as possible wherein the cabinet shell is formed from a one-piece blank stamped from metallic sheet stock and folded into side-by-side closed rectangular loop sections to provide both a cooking compartment and a components compartment containing a power supply and controls, which compartments provide a maximum interior volume for a given exterior dimension.

It is another object of the present invention to provide an improved microwave oven cabinet shell as set forth above wherein the one-piece blank presents a divider panel, a first oven chamber bottom panel, a first left side panel, a combined top panel, a second right side panel and a second components chamber panel serially arranged in the order named and foldably connected at fold lines forming five corner junctures of the rectangular loop sections.

It is another object of the present invention to provide an improved microwave oven cabinet shell as set forth in the above objects wherein an outer wrap is provided facing selected exterior walls of the shell to form an outer appearance surface thereon.

These and further objects, advantages and features of the invention will become more fully apparent as reference is had to the accompanying specification and drawings wherein.

Figure 1:
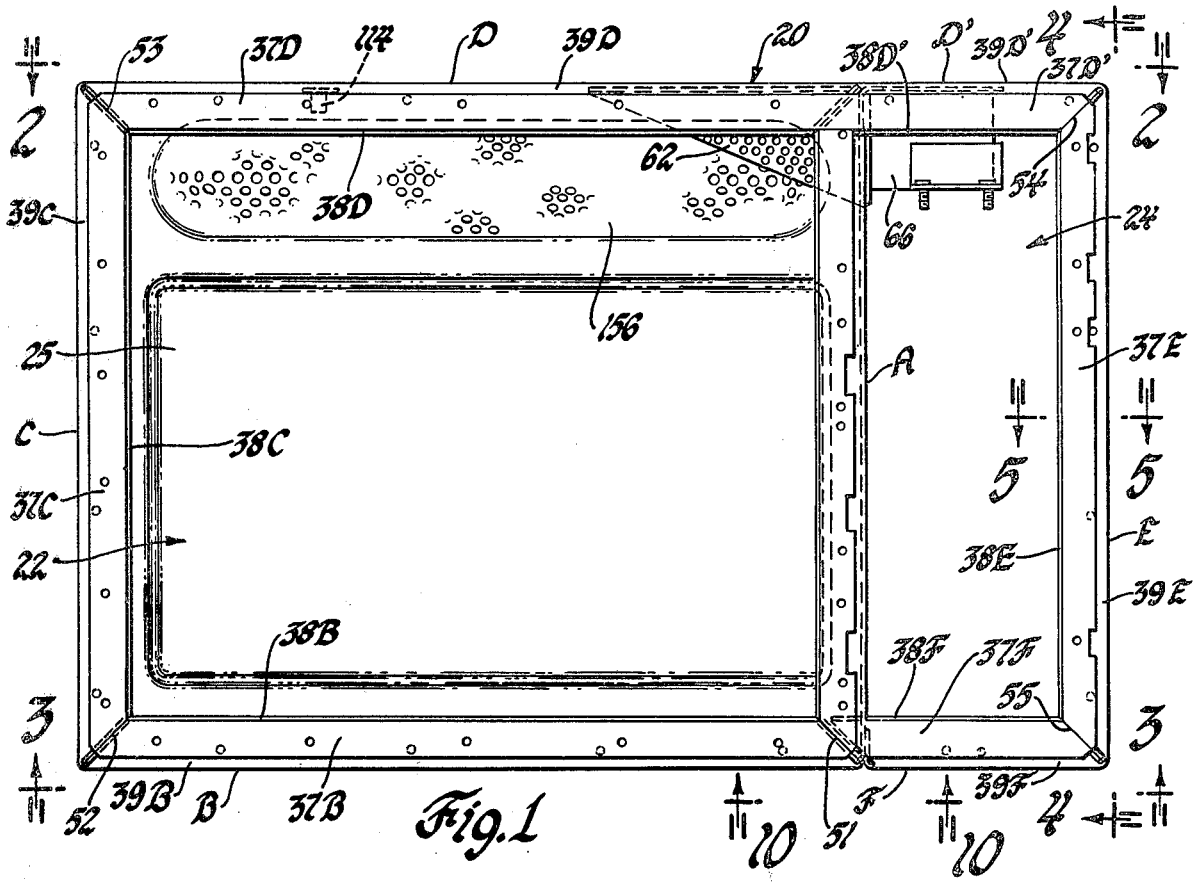
FIG. 1 is a front elevational view of a microwave oven cabinet illustrating the present invention with the door structure not shown.
Figure 13:
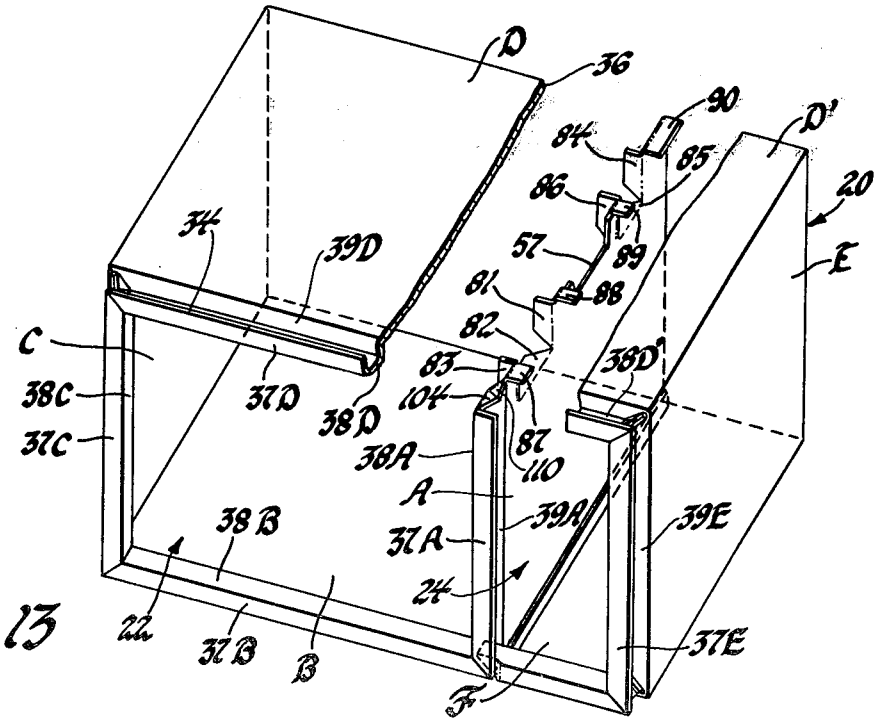
FIG. 13 is a perspective view of the microwave oven cabinet outer shell with parts broken away to show details of the structure.

Referring now to FIGS. 1 and 13 of the drawings, there is shown a microwave oven cabinet shell, generally indicated at 20, formed from a one-piece blank defining an oven or cooking compartment 22 and a components compartment 24. A separate cover panel, not shown, is provided at the front of the components compartment 24 serving as a control panel containing user information, knob, touch controls, push buttons and the like. The control panel together with a separate one-piece back panel 25 closes the back of the cooking compartment 22 while a peripheral right angle frame 26 defines the rear opening in the compartment 24 containing a power supply, control elements, etc.

As a first step a blank shown at 30 in FIG. 1, for forming the microwave oven shell 20 is cut to proper length and width from metallic sheet stock 32 such as cold rolled steel. The blank 30 may be either stamped-out of sheet stock or coil supply stock that is fed into a punch press, for example. The punch press trims the blank front 34 and rear 36 edges to the desired front to rear width of the cabinet shell to be made, plus an additional width sufficient to form three longitudinally extending inner 37, intermediate 38, and front 39 flanges for subsequent folding or bending along longitudinal fold lines 40, 41 and 42.

Also, as a part of the first step the punch press cuts a pattern of corner development notches 51, 52, 53, 54 and 55 in the unfolded front flanges 37, 38 and 39 at the front end of blank transverse fold lines 51', 52', 53', 54', and 55'. The transverse fold lines 51'-55' divide the blank 30 into a divider panel A, a first bottom oven panel B, a left side panel C, a top panel comprising a top left panel D and a top right panel D', a second right side panel E and a second bottom right panel F serially arranged in the order named.

Figure 2:
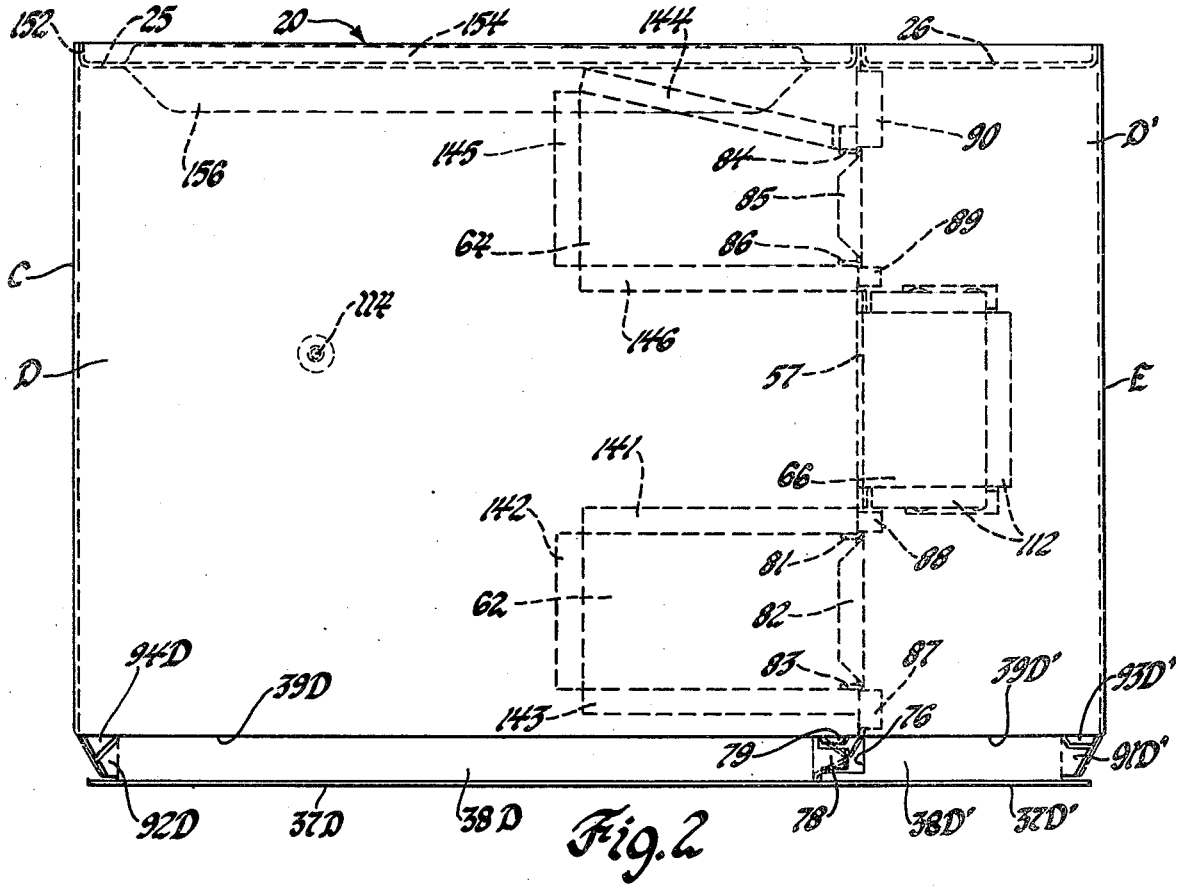
FIG. 2 is a top elevational view of the cabinet taken on line 2—2 of FIG. 1.
Figure 3:
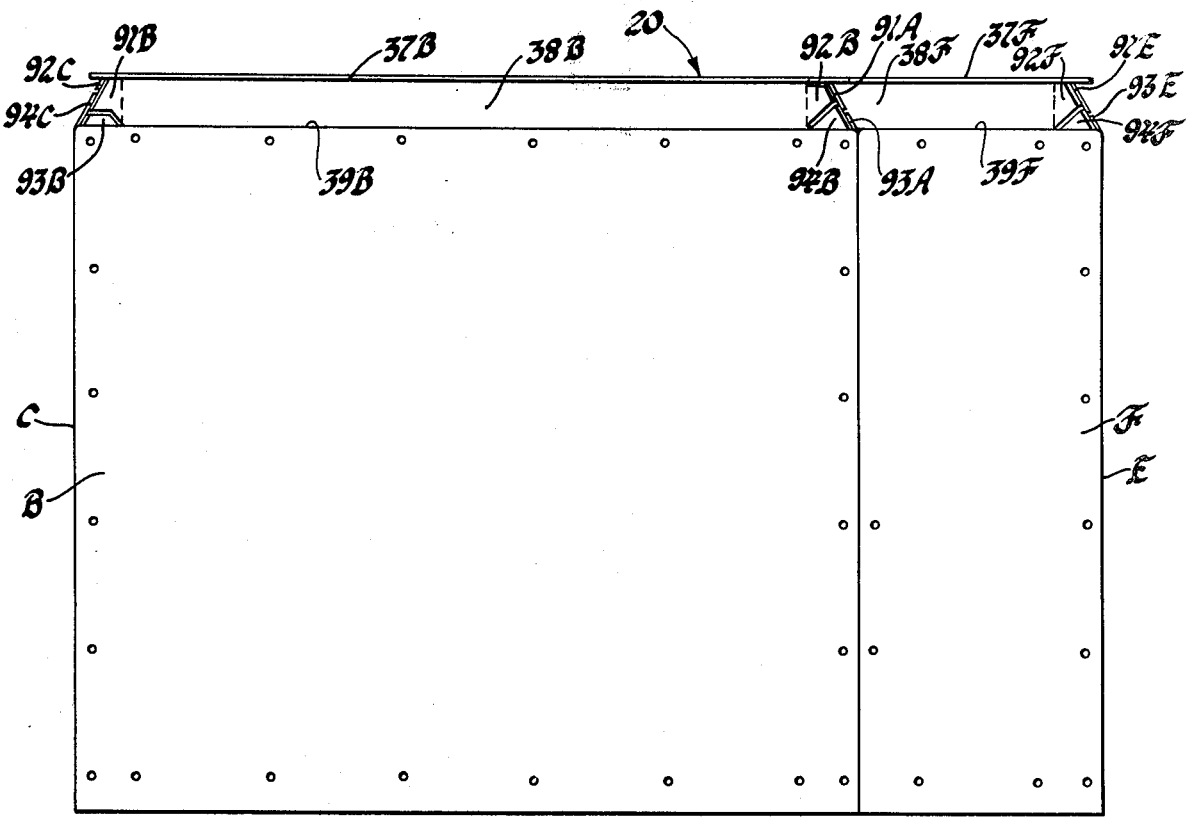
FIG. 3 is a bottom elevational view of the cabinet taken on line 3—3 of FIG. 1.
Figure 4:
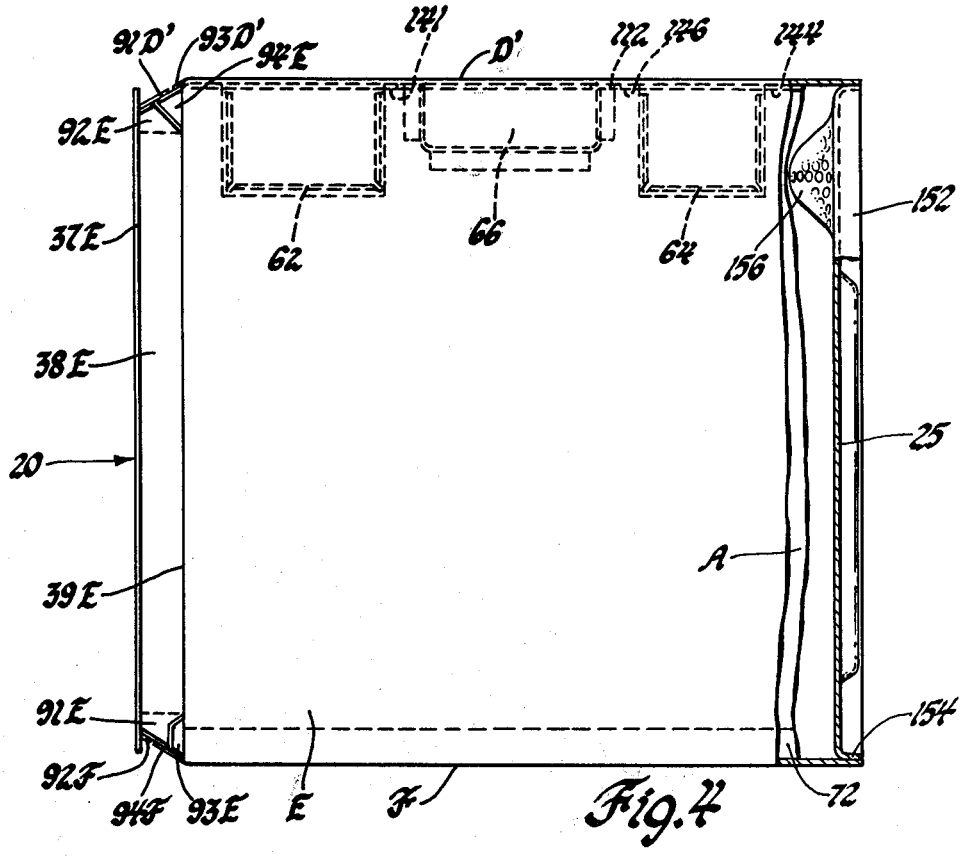
FIG. 4 is an elevational view of the right hand side of the cabinet taken on line 4—4 of FIG. 1.

During the blanking operation the punch press lances out rectangular or U-shaped areas 56, 57 and 58 in free edge 59 of the divider panel A for the reception of a pair of air duct members. As seen in FIGS. 1 and 2 in the disclosed form, the U-shaped area 56 is designed to receive an air exit duct 62 while the U-shaped area 58 receives an air inlet duct 64. The center U-shaped area 57 is shaped to receive a box-like waveguide component shown at 66 in FIG. 2. It will be noted that as part of the first step the bottom right panel F may be cut or lanced so that a series of louvers may be formed therein as part of he microwave air distribution system to be described.

Additionally, at the time of stamping as part of the first step the punch press lances out triangular notch 70 defining left hand end flanges 72 and 73 along the free edge 74 of panel F. The blank 30 has an aperture 76 cut on the construction line 77 separating the panels D and D' so as to form flaps 78 and 79 for a purpose to be explained.

Finally, during the first step a one-half corner notch 80, flanges 81–86 at the U-shaped areas 56 and 58 and right hand flanges 87, 88 and 90 are lanced out at the free end of divider panel A for subsequent folding or bending in a manner to be described.

Figure 12:
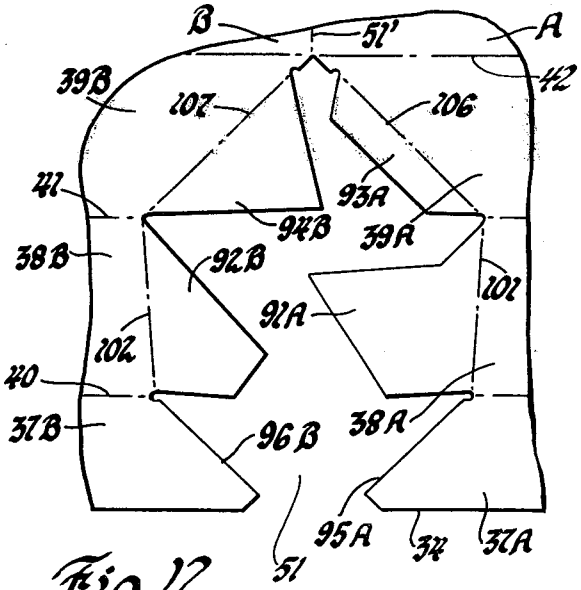
FIG. 12 is an enlarged plan view of one of the notched-out corner areas shown in FIG. 11.

It will be appreciated that the notched-out corner areas 51–55 are lanked in identical patterns represented by enlarged area 51 in FIG. 12 to define corner gussets between divider panel A and bottom left panel B. With reference to FIG. 12 it will be seen that intermediate five-sided corner gusset 91A of intermediate flange 38A and inner trapezoidal corner gusset 93A of inner flange 39A are formed; while trapezium shaped corner gusset 92B of intermediate flange 38B and inner triangular corner gusset 94B of inner flange 39B are formed. Further, the 45° edges 95A and 96B are formed from outer flanges 37A and 37B respectively.

Figure 5:
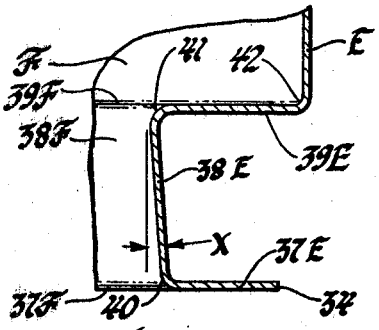
FIG. 5 is an enlarged fragmentary sectional view taken on line 5—5 of FIG. 1.
Figure 6:
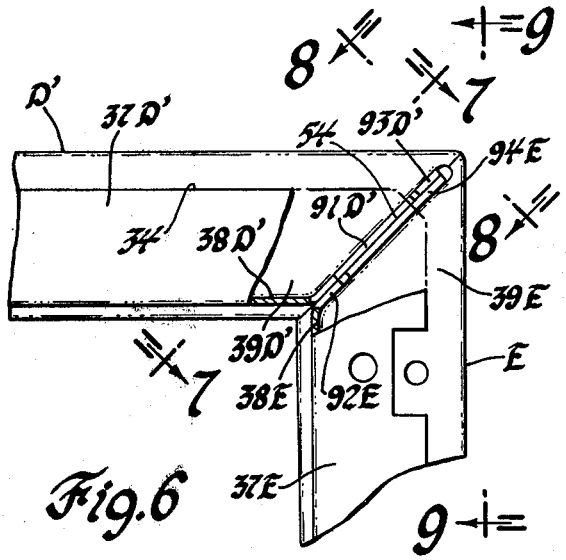
FIG. 6 is an enlarged fragmentary front elevational view of the upper right hand corner with parts broken away.
Figure 7:
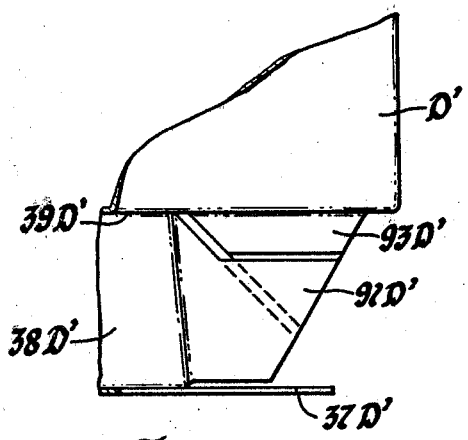
FIG. 7 is a fragmentary sectional view taken substantially on the line 7—7 of FIG. 6.
Figure 8:
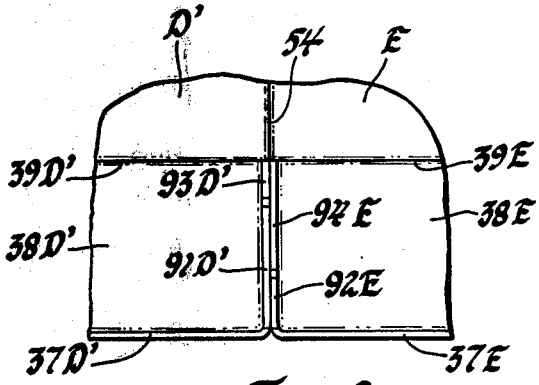
FIG. 8 is a fragmentary elevational view taken on the line 8—8 of FIG. 6.
Figure 9:
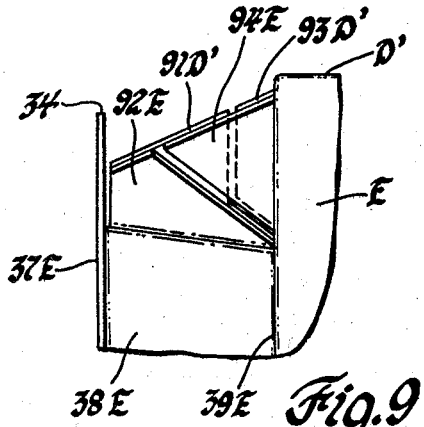
FIG. 9 is a fragmentary elevational view taken on the line 9—9 of FIG. 6.

In the second step the blank 30 is operated on by a roll form apparatus which forms the three substantially right-angle bends 40, 41 and 42 as seen in the typical section of FIG. 5. Each flange portion is formed into an inwardly 39E, forwardly 38E and outwardly 37E projecting channel as seen in FIGS. 5 and 13 for right-side wall panel E. The six formed channel sections for their respective panels A-F define in their completed arrangement the cabinet access openings surrounding the cooking compartment 22 and the components compartment 24 so as to provide a rigid double opening frame for supporting a suitable oven door.

Figure 10:
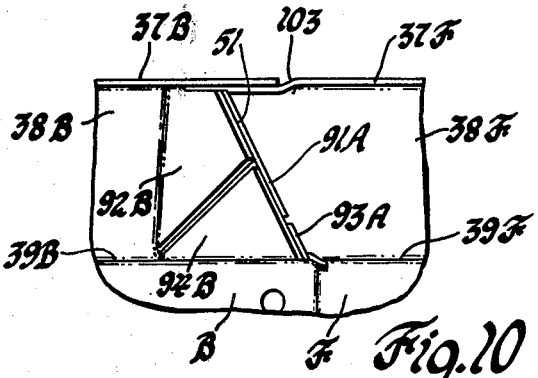
FIG. 10 is a fragmentary sectional view taken on line 10—10 of FIG. 1.
Figure 11:
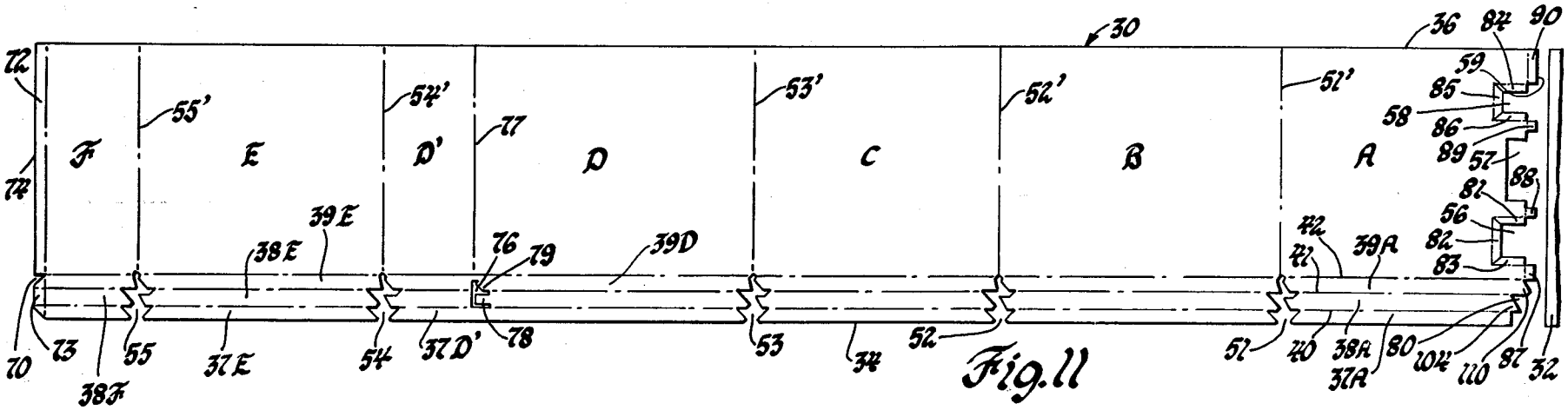
FIG. 11 is a plan view of the one-piece blank showing its notched-out sections.

A third step of vertically Vee-Forming the corner notches, an offset and flange will now be described. This step may be performed by vertically moving block (not shown) having a right-angled end cooperating with a die (not shown) having a right-angled notch. The block bends or folds the corner gussets such as corner gussets 91A and 92B along their fold lines 101 and 102 respectively, downwardly at an angle of about 45° to the horizontal at each of the corner notches 51–55. Further, the flap 78 is bent downwardly at about a 45° angle to the plane of the blank 30 by a suitable vertically moving block. As part of the third step the offset 37F, shown at 103 in FIG. 10 is formed for a purpose to be explained. Also, two-sided gusset 104 of corner notch 80 is folded at a 45° angle. The third step also involves forming the end flange 72 of panel F by bending same upwardly from the plane of the blank 30 at an angle of 90° along with the flanges 81–86. The right hand end flanges 87–90 are bent downwardly from the plane of the blank 30 at an angle of 90°.

A fourth step involves horizontally Vee-Forming the corner notches in a manner similar to the vertical Vee-Forming operation. Thus, all the interior corner gussets, such as 93A and 94B of FIG. 12 are bent or folded downwardly at an angle of about 45° to the plane of the blank 30 about their fold lines 106 and 107, respectively. In addition the gusset 79 at aperture 76 and gusset 110 at corner 80 are folded downwardly at a 45° angle to the blank 30.

As an additional operation during step four the wave guide 66 is secured to blank 30 by means of its peripheral flange 112 being spot welded to the underside of the top right panel D', as seen in FIGS. 1 and 2 of the final assembly. Also, attaching means, such as a T-nut 114, may be secured to the underside of the D top left panel, as shown in FIGS. 1 and 2, for mounting a rotatable stirrer in the final assembly of the appliance.

A fifth step in the formation of the cabinet involves folding the divider panel A about fold line 51' through a 90° angle relative to panel B and spot welding the gusset 91A to both gussets 92B and 94B, and spot welding gusset 93A to gusset 94B to form the completed corner 51 as shown best in FIG. 10. Also, as a part of the fifth step the bottom right hand panel F is folded at 90° relative to panel E to enable spot welding the gusset 91E to both the gussets 92F and 94F, and spot welding gusset 93E to gusset 94F to form completed corner 55 as partially shown in FIG. 13. The air ducts 62 and 64 are welded to their respective divider panel flanges 81–83 and 84–86, respectively, as a final operation of the fifth step. A sixth step involves folding the panel B about fold line 52' through an angle of 90° relative to panel C and spot welding the gusset 91B to both gussets 92C and 94C and spot welding gusset 93B to gusset 94C to form the completed corner 52.

A seventh step involves folding the left side panel C about fold line 53' through an angle of 90° relative to panel D and spot welding the gusset 91C to both gussets 92D and 94D, and spot welding gusset 93C to gusset 94D to form the completed corner 53. Also, the peripheral flanges 112 of the wave guide are spot welded to the panel D' while flanges 141–143 of air duct 62 and flanges 144–146 of air duct 64 are welded to panel D. Step seven is completed by spot welding flange tabs 87–90 to panel D'.

An eighth step involves folding panel E about fold line 54' through an angle of 90° relative to panel D' and spot welding gusset 91D' to both gussets 92E and 94E, and spot welding gusset 93D' to gusset 94E to form the completed corner 54. Further, the end flange 72 is spot welded to divider panel A.

As a final ninth step in the formation of the microwave cabinet, back panel 25 is welded to the inner surfaces of the cooking compartment panels A, B, C and D at their rearward periphery by means of back panel flanges such as flanges 152 and 154 shown in FIG. 2. It will be noted that the back panel 25 has an inwardly deformed portion 156, which in the preferred form is perforated in the manner of air ducts 62 and 64, to provide for light to enter the cooking compartment from a light source (not shown) mounted outside the cabinet back panel 25. The control compartment frame 26 is secured in a manner similar to that set forth for back panel 25.

It will be appreciated that in the disclosed embodiment applicant's channel section, shown in FIG. 5, is not symmetrical in that the bend along fold line 41 is somewhat greater than 90°, while the bend along fold line 40 is somewhat less than 90°. The result of this is that the surface flange 38E is provided having a slightly outwardly tapered surface by an amount indicated by an angle X. In a similar manner the flange surfaces 38A, 38B, 38C and 38D, outwardly tapered by the same angle X, are designed to extend peripherally around a door closing the cooking compartment to assure a snug fit after closing.

Figure 14:
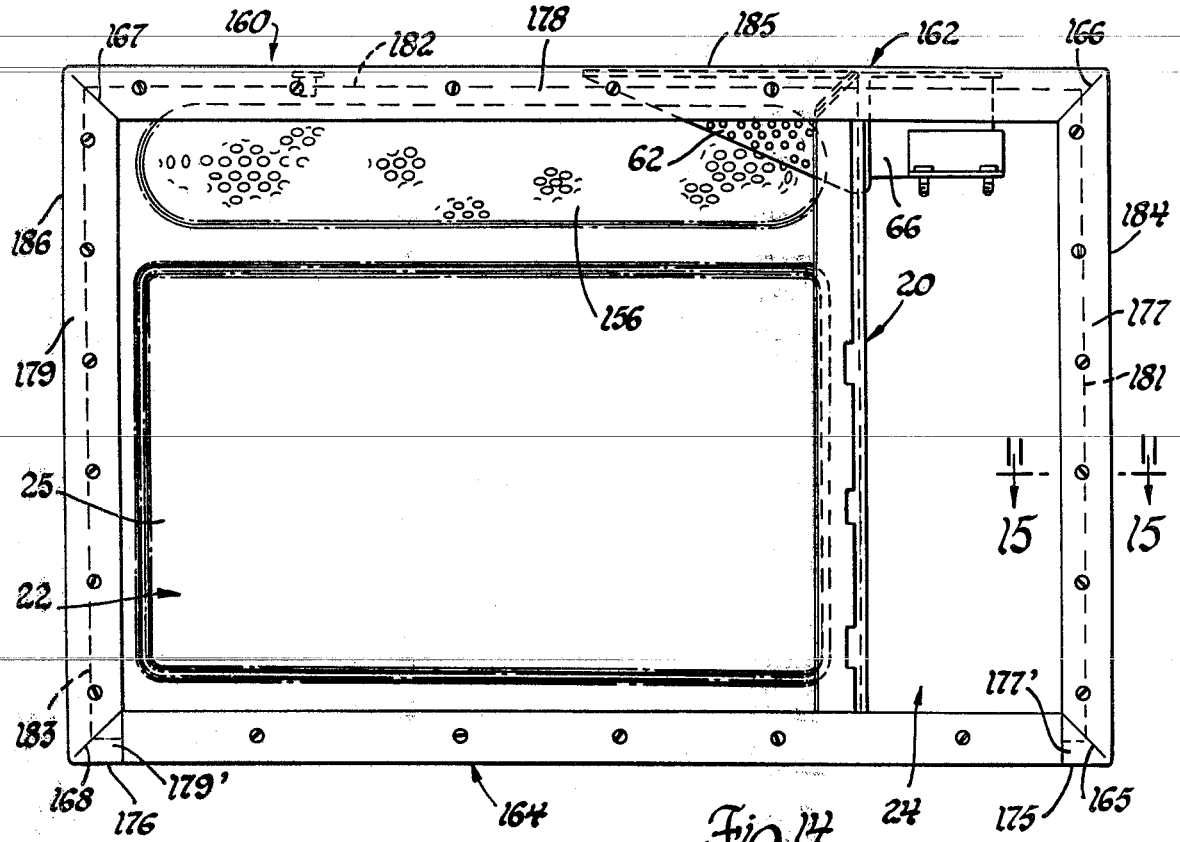
FIG. 14 is a front elevational view of the microwave oven cabinet shell of FIG. 1 together with its inverted U-shaped cover and angle member.
Figure 16:
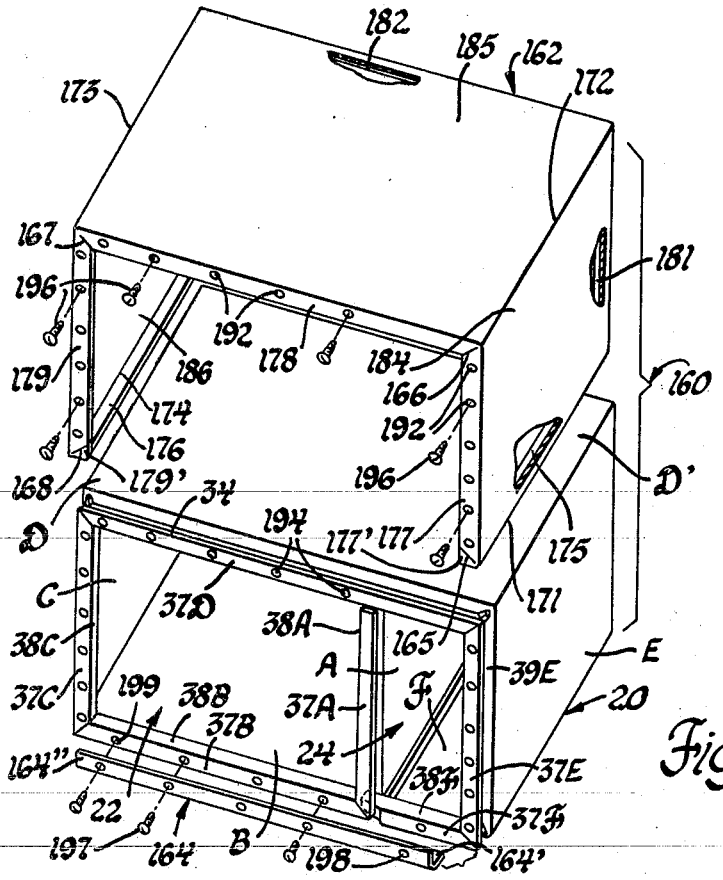
FIG. 16 is an exploded perspective view of the microwave oven cabinet outer shell, inverted U-shaped cover and angle member.
Figure 15:
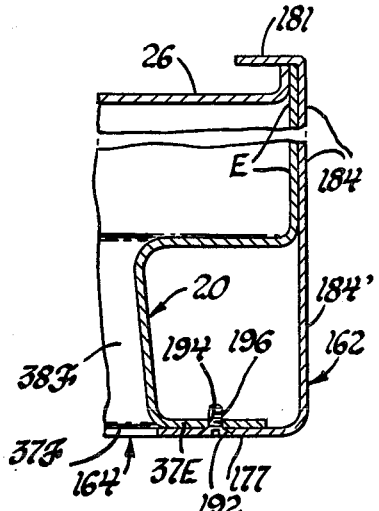
FIG. 15 is an enlarged fragmentary true horizontal sectional view taken on line 15—15 of FIG. 14.

In accordance with the present invention, the cabinet shell assembly, generally indicated by the numeral 160 in FIGS. 14–16, includes the cabinet shell 20, outer one-piece cover or wrap 162 and angle member 164. The wrap 162 is initially a rectangular flat blank (not shown) cut to proper length and width from galvanized sheet steel supply stock. In the preferred form one side of the blank is pre-finished such as by the application of a vinyl coating, an embossed pattern, painting or other decorative treatment.

The blank is of a width equal to the desired front to rear depth of the cabinet shell 20 plus additional amounts sufficient to form flanges on each side thereof. The cover blank is of a length sufficient to extend across the cabinet shell top panels D, D' and down both side panels C and E with additional amounts at each end to form end flanges of desired width. As a further operation, the cover blank flanges have corner development notches such as shown at 165, 166, 167 and 168 cut at the end of each of its transverse fold lines 171, 172, 173 and 174 to form corners in a conventional manner.

As a next step all of the edges of the blank are folded to an angle of about 90° to form end flanges 175 and 176, front terminal flanges 177, 178 and 179 on one side and rear terminal flanges 181, 182 and 183 on the opposite side. As a next step, illustrated in FIG. 16, the blank is folded upon the lines 172 and 173 to a 90° angle to form the blank into the inverted U-shaped cover or wrap 162. In this inverted U-shape, a top sheet material portion 185 is of a predetermined size to face the cabinet shell top panels D and D' while the side sheet material portions 184 and 186 are of predetermined sizes to face the cabinet shell side panels E and C, respectively, forming outer appearance surfaces for the microwave cabinet shell.

As best seen in FIG. 15, the cover or wrap top and side portions each include an extension, indicated at 184' formed on side portion 184, bridging the cabinet shell channel. In this manner, each top and side portion terminal flange faces the exterior edge of the cabinet flange portion channels as shown by terminal flange 177 facing the exterior edge of channel portion 37E. Suitable aperatures 192 are provided in the front terminal flanges 177, 178 and 179 spaced for alignment with aperature 194 in channel portions 37C, 37D and 37E for reception of fastener means such as metal screw 196.

In this regard the angle member 164 is provided of a predetermined length so as to extend along the cabinet shell lower channel portions 37B and 37F such that its opposite ends are juxtaposed to the vertical edges of end flanges triangular portions 177' and 179' as seen in FIG. 14. Thus, the angle member 164 horizontally disposed leg 164' is disposed to bridge the channel portions 37 and 38 while its vertically disposed leg 164" is disposed to face the exterior edges of channel flange portions 37F and 38F. The angle member 164 is suitably secured to the cabinet shell which in the disclosed form is by means of metal screws 197 extending through aperature 198 on leg 164" and aligned aperature 199 in channel portions 37B and 37F.

While the embodiment of the present invention as herein disclosed constitutes a preferred form, it is to be understood that other forms might be adopted.

The embodiments of the invention in which an exclusive property or privilege is claimed are defined as follows:

1. A microwave oven cabinet shell for maximizing interior volume while minimizing scrappage, said shell having side-by-side closed rectangular loop sections partially defining cooking and control compartments, the loop sections being formed from a one-piece blank presenting a divider panel, a first bottom panel, a first side panel, a top panel, a second side panel and a second bottom panel serially arranged in the order named and foldably connected at fold lines forming five corner junctures of said rectangular loop sections, said divider panel forming a common partition wall between said control compartment and said cooking compartment, said first bottom panel forming an exterior bottom wall of said cooking compartment, said first side panel forming one exterior side wall of said cooking compartment, a portion of said top panel adjacent said first side panel forming the exterior top wall of said cooking compartment, the remaining portion of said top panel adjacent said second side panel forming the exterior top wall of said control compartment, said second side panel forming the exterior side wall of said control compartment, and said second bottom panel forming the exterior bottom wall of said control compartment, thereby to form with single wall construction the cavities of said cooking and control compartments, attachment means on the free edge of said divider panel for securing said divider panel free edge to the inner face of said top panel thereby defining the longitudinal separation of said cooking compartment top wall and said control compartment top wall, said second bottom panel free edge having flange means for securing said second bottom panel free edge to the outer face of said divider panel adjacent its corner juncture with said first bottom panel, the forward edge of said blank being integrally provided with a coextensive flange, said blank flange at its associated fold lines being notched-out in a predetermined manner providing each panel with a flange portion having integral foldable opposed gussets at each free end thereof, each said flange portion being formed in section into a downwardly, forwardly and upwardly projecting channel; whereby upon the formation of the loop sections and the folding of the gussets to a common diagonal plane with respect to the corner junctures and upon securing to each other at said plane the abutting surfaces of the juxtaposed gussets on adjacent flange portions, a microwave cabinet shell is formed with maximum interior volume for any predetermined exterior dimension which has rectangular channel framed openings for the cooking compartment and the control compartment, whereby sufficient rigidity is imparted to strengthen the cabinet and support a door adapted for closing the opening for said cooking compartment.

2. A microwave oven cabinet shell for maximizing interior volume while minimizing scrappage, said shell having side-by-side closed rectangular loop sections partially defining cooking and control compartments, the loop sections being formed from a one-piece blank presenting a divider panel, a first bottom panel, a first side panel, a top panel, a second side panel and a second bottom panel serially arranged in the order named and foldably connected at fold lines forming five corner junctures of said rectangular loop sections, said divider panel forming a common partition wall between said control compartment and said cooking compartment, said first bottom panel forming an exterior bottom wall of said cooking compartment, said first side panel forming one exterior side wall of said cooking compartment, a portion of said top panel adjacent said first side panel forming the exterior top wall of said cooking compartment, the remaining portion of said top panel adjacent said second side panel forming the exterior top wall of said control compartment, said second side panel forming the exterior side wall of said control compartment, and said second bottom panel forming the exterior bottom wall of said control compartment, thereby to form with single wall construction the cavities of said cooking and control compartments, attachment means on the free edge of said divider panel for securing said divider panel free edge to the inner face of said top panel thereby defining the longitudinal separation of said cooking compartment top wall and said control compartment top wall, said second bottom panel free edge having attachment means for securing said second bottom panel free edge to the outer face of said divider panel adjacent its corner juncture with said first bottom panel, the forward edge of said blank being integrally provided with a coextensive flange, said blank flange at its associated fold lines being notched-out in a predetermined manner providing each panel with a flange portion having integral foldable opposed gussets at each free end thereof, each said flange portion being formed in section into a downwardly, forwardly and upwardly projecting channel terminating in an exterior edge; whereby upon the formation of the loop sections and the folding of the gussets to a common diagonal plane with respect to the corner junctures and upon securing to each other at said plane the abutting surfaces of the juxtaposed gussets on adjacent flange portions, a microwave cabinet shell is formed with maximum interior volume for any predetermined exterior dimension which has rectangular channel framed openings for the cooking compartment and the control compartment, whereby sufficient rigidity is imparted to strengthen the cabinet and support a door adapted for closing the opening for said cooking compartment, said cabinet shell including an outer wrap for the shell on selected ones of said exterior walls requiring an appearance finish, said wrap consisting of sheet material facing the selected exterior walls to form an outer appearance surface theron.

3. A microwave oven cabinet shell for maximizing interior volume while minimizing scrappage, said shell having side-by-side closed rectangular loop sections partially defining cooking and control compartments, the loop sections being formed from a one-piece blank presenting a divider panel, a first bottom panel, a first side panel, a top panel, a second side panel and a second bottom panel serially arranged in the order named and foldably connected at fold lines forming five corner junctures of said rectangular loop sections, said divider panel forming a common partition wall between said control compartment and said cooking compartment, said first bottom panel forming an exterior bottom wall of said cooking compartment, said first side panel forming one exterior side wall of said cooking compartment, a portion of said top panel adjacent said first side panel forming the exterior top wall of said cooking compartment, the remaining portion of said top panel adjacent said second side panel forming the exterior top wall of said control compartment, said second side panel forming the exterior side wall of said control compartment, and said second bottom panel forming the exterior bottom wall of said control compartment, thereby to form with single wall construction the cavities of said cooking and control compartments, attachment means on the free edge of said divider panel for securing said divider panel free edge to the inner face of said top panel thereby defining the longitudinal separation of said cooking compartment top wall and said control compartment top wall, said second bottom panel free edge having flange means for securing said second bottom panel free edge to the outer face of said divider panel adjacent its corner juncture with said first bottom panel, the forward edge of said blank being integrally provided with a coextensive flange, said blank flange at its associated fold lines being notched-out in a predetermined manner providing each panel with a flange portion having integral foldable opposed gussets at each free end thereof, each said flange portion being formed in section into a downwardly, forwardly and upwardly projecting channel terminating in an exterior edge; whereby upon the formation of the loop sections and the folding of the gussets to a common diagonal plane with respect to the corner junctures and upon securing to each other at said plane the abutting surfaces of the juxtaposed gussets on adjacent flange portions, a microwave cabinet shell is formed with maximum interior volume for any predetermined exterior dimension which has rectangular channel framed openings for the cooking compartment and the control compartment, whereby sufficient rigidity is imparted to strengthen the cabinet and support a door adapted for closing the opening for said cooking compartment, said cabinet shell including an outer wrap for the shell on selected ones of said exterior walls requiring an appearance finish, said wrap consisting of sheet material facing the selected exterior walls to form an outer appearance surface thereon, said sheet material including an extension bridging the channel portions associated with the selected exterior walls and having terminal flanges facing the exterior edge of said bridged channel portions to form an outer appearance surface thereon.

* * * * *

UNITED STATES PATENT OFFICE

CERTIFICATE OF CORRECTION

PATENT NO. : 4,192,431

DATED : March 11, 1980

INVENTOR(S) : Richard C. Brown

It is certified that error appears in the above-identified patent and that said Letters Patent are hereby corrected as shown below:

1st page of patent under the heading of "Related U.S. Application Data" on bracketed line "[63]" at end of this line, change "1971" to ------- 1977 ----------.

Column 2, Line 31, after the word "FIG." change "1" to -- 11 ---

Column 2, Line 64, change "he" to ------ the -----.

Signed and Sealed this

*Twenty-fourth* Day of *June 1980*

[SEAL]

*Attest:*

SIDNEY A. DIAMOND

*Attesting Officer*

*Commissioner of Patents and Trademarks*